US006168531B1

(12) United States Patent
Adamson et al.

(10) Patent No.: US 6,168,531 B1
(45) Date of Patent: Jan. 2, 2001

(54) SOUP BOWL ATTRACTION

(75) Inventors: William George Adamson, Glendora; Donald Lewis Updyke, Jr., Palmdale, both of CA (US)

(73) Assignees: Sony Corporation, Tokyo (JP); Hyper Entertainment Inc., Burbank, CA (US)

( * ) Notice: Under 35 U.S.C. 154(b), the term of this patent shall be extended for 0 days.

(21) Appl. No.: 09/333,197

(22) Filed: Jun. 15, 1999

(51) Int. Cl.[7] ..... A63J 5/02
(52) U.S. Cl. ..... 472/61; 472/65; 40/427
(58) Field of Search ..... 472/57, 61, 63, 472/64, 65, 67, 68, 137; 40/427, 428

(56) References Cited

U.S. PATENT DOCUMENTS 3,432,439 * 3/1969 Dickman ..... 472/65 X
4,303,397 * 12/1981 Swiatosz ..... 472/65 X
5,156,333 * 10/1992 Worsfold ..... 472/65 X
5,224,901 * 7/1993 Dahl et al. ..... 472/63
5,407,392 * 4/1995 Laijoki-Puska ..... 472/65
5,951,405 * 9/1999 Eigenmann ..... 472/61

* cited by examiner

*Primary Examiner*—Kien T. Nguyen
(74) *Attorney, Agent, or Firm*—Christopher M. Tobin

(57) ABSTRACT

A simulated soup bowl entertainment attraction, comprising: a bowl-shaped member having a top bounded by a top rim, a bottom permitting light transmission therethrough, and sidewalls connecting the top rim with the bottom; a fog generator producing a fog layer at the top of the bowl-shaped member; and an imaging device producing an image within the bowl-shaped member, the image viewable from a viewing position looking down into the top of the bowl-shaped member. Preferably, the bowl shaped entertainment attraction includes an image controlling apparatus coupled to the imaging device for changing the image viewable from the viewing position. Optionally, apparatus producing sound within the bowl-shaped member may be provided. The bowl shaped entertainment attraction may include a sound controlling apparatus coupled to a sound system for selectively changing the sound heard from within the bowl-shaped member.

50 Claims, 5 Drawing Sheets

FIG. 5
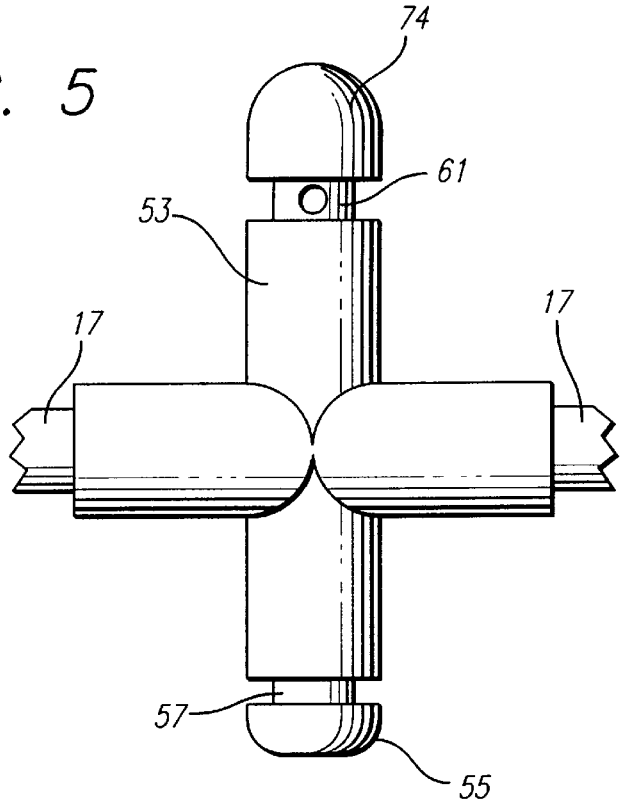
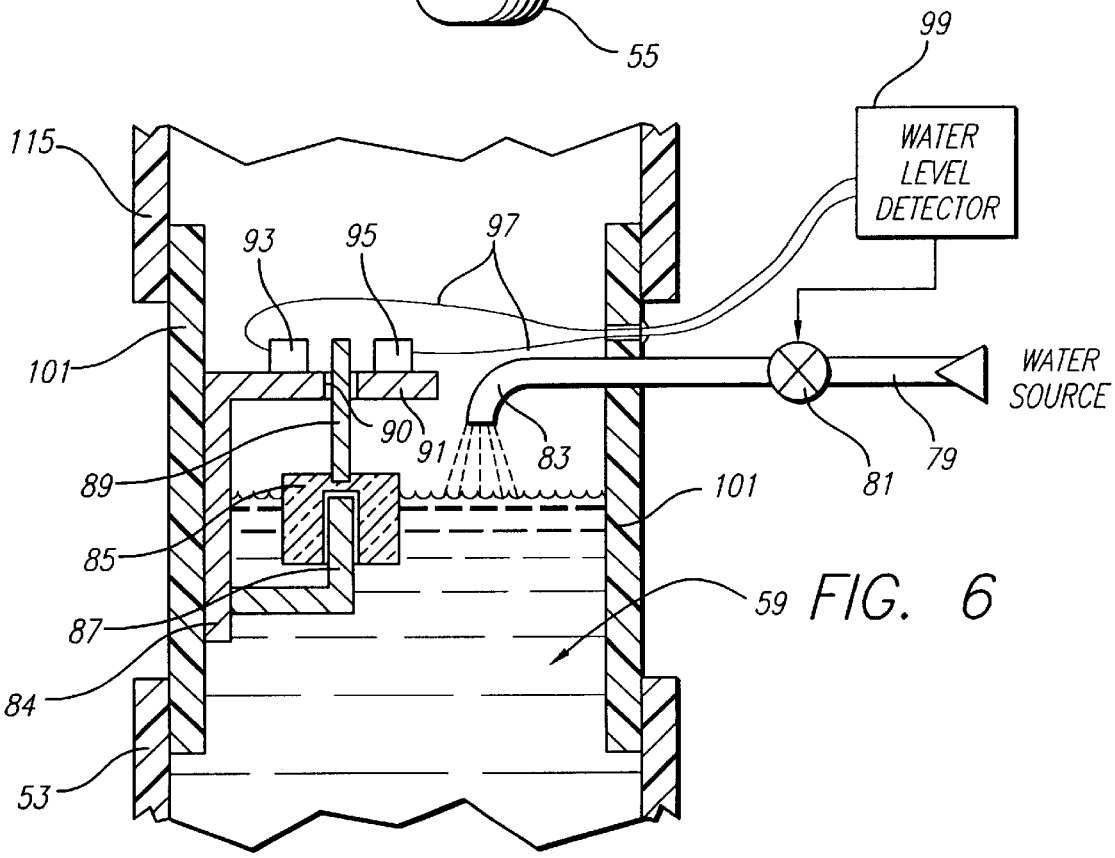
FIG. 6

SOUP BOWL ATTRACTION

FIELD OF THE INVENTION

This invention is related to the field of entertainment, and more particularly to an interactive attraction providing entertaining activities for a participant.

BACKGROUND OF THE INVENTION

Interactive entertainment attractions are generally in the nature of a video game apparatus in which a participant manipulates buttons and levers, or otherwise imparts physical movement of a device, to cause changing visual and audible effects.

Although video games differ in the visual and audible presentations, the methodology, i.e. activities of the participants, are predictable and remain basically the same, leading to familiarity, boredom and disinterest. Moreover, such entertainment attractions typically limit usage at any point in time to one or two participants.

Accordingly, there is a need in the art for an entertainment attraction alternative which departs from the usual button pushing, lever bending video game type of activity, and which permits several participants to take part in the attraction activity within a relatively short period of time.

SUMMARY OF THE INVENTION

A bowl shaped entertainment attraction is disclosed which includes a bowl shaped member having a top and a bottom. In addition, the attraction includes a fog generator which produces a fog layer in the bowl shaped member. Further, the attraction includes an image producer which produces an image within the bowl shaped member that is viewable through the fog layer.

More specifically, the present invention provides a bowl shaped entertainment attraction, comprising: a bowl shaped member having a top, a bottom, and an interior; a fog generator producing a fog layer within and/or at the top of the bowl shaped member; and an imaging device producing an image within the bowl shaped member.

In another aspect of the invention, there is provided a simulated soup bowl entertainment attraction, comprising: a bowl-shaped member having a top bounded by a top rim, a bottom permitting light transmission therethrough, and sidewalls connecting the top rim with the bottom; a fog generator producing a fog layer at the top of the bowl-shaped member; and an imaging device producing an image within the bowl-shaped member, the image viewable from a viewing position looking down into the top of the bowl-shaped member.

Preferably, the simulated soup bowl entertainment attraction includes an image controlling apparatus coupled to the imaging device for changing the image viewable from the viewing position.

For example, the imaging device may comprise a projector projecting an image onto a rear projection screen displaying the projected image, the screen being disposed within the soup bowl-shaped member beneath the fog layer. A sensor apparatus is provided to sense the presence of an object positioned over the top of the bowl-shaped member, and in particular the sensor apparatus will sense the presence of a participant's hand being held over the top rim of the soup bowl member. Upon sensing the presence of a participant's hand above the top rim, the image controlling apparatus changes the image being viewed, e.g. the projector changes slides.

When another participant places his or her hand above another segment of the bowl-shaped member, such action is detected by the sensing apparatus, and the image controlling apparatus causes the imaging device to again change images being displayed under the fog layer as viewed from above the bowl-shaped member.

In an embodiment of the invention, the top of the bowl-shaped member is divided into segments, e.g. six pie-shaped segments, and a particular slide in the slide projector will be selected for each of the six sectors on a correlated one-to-one basis.

Alternatively, the slide projector may include a carousel having many slides available for display, and each time a participant's hand is moved over the top rim of the bowl-shaped member into one of the segments, the sensor apparatus senses that event, causing the image controlling apparatus to change the image in the imaging device. If desired, such changing of images may be random or may be presented sequentially in any particular desired order.

Either on a time basis, or on a number of objects sensed basis, a predetermined slide will be selected for display on the screen, the image having the shape of a large arrow pointing in the direction in which the participant is requested to go for exiting the entertainment attraction and for being properly directed to another entertainment attraction.

Although a projector and slide arrangement is an embodiment for an imaging device, any visual display device can be substituted for the projector and slide arrangement, such as a video projector (similar to the system in a rear-projection television system), or an active display surface having individually eliminated pixels as controlled by a display control device (similar to the display on a laptop computer screen).

The enjoyment afforded a participant by the present invention is enhanced by optionally providing a sound system which produces a unique sound for, and correlated with, each selectable image. A store of sound clips may take the form of tracks on a compact disk or other suitable quick indexing multiple recorded sound medium. The selection of sounds to be heard by the participant functionally parallels the selection of images by the aforementioned imaging device and image control apparatus.

BRIEF DESCRIPTION OF THE DRAWINGS

Further objects and advantages and a better understanding of the present invention may be had by reference to the following detailed description taken in conjunction with the accompanying drawings in which:

FIG. 5 is a rear elevational view of one of a plurality of fog generators spaced around the interior of a simulated soup bowl member in the soup bowl entertainment attraction; and FIG. 6 is a side cross sectional view of one of the fog generator units showing the relative location of the water source pipeline and water level controller components.

DETAILED DESCRIPTION OF THE INVENTION

Figure 1:
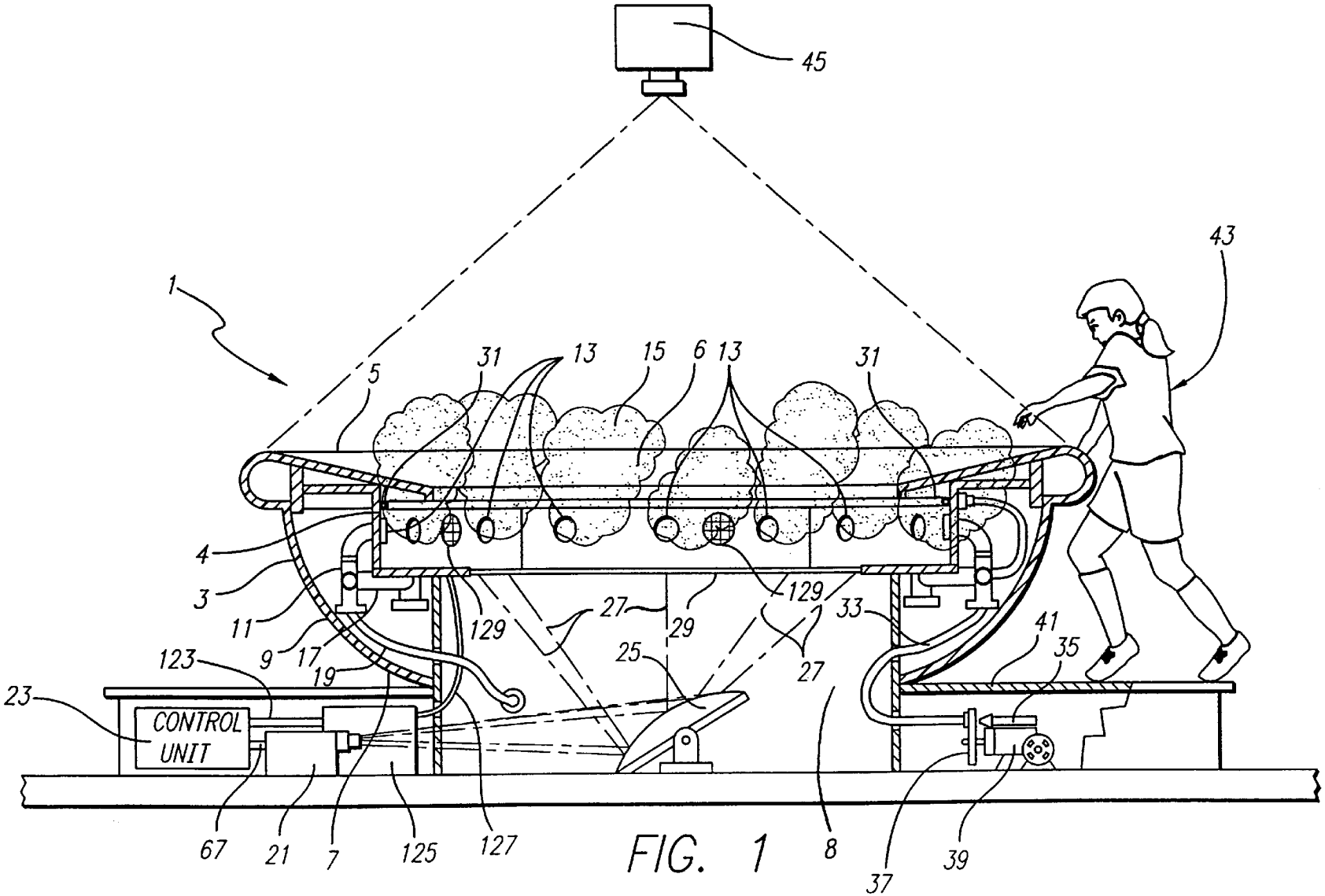
FIG. 1 is a cross sectional side elevational view of the simulated soup bowl entertainment attraction in accordance with an embodiment of the present invention.

FIG. 1 is a cross sectional side elevational view of the simulated soup bowl entertainment attraction 1 constructed in accordance with an embodiment of the present invention.

A bowl shaped member 3 is supported by an internal frame structure 4. The bowl shaped member 3 has a top 5 bounded by a peripheral top rim 6 having an annular configuration. The bowl shaped member 3 further includes a bottom portion 7 which is smaller in size than the top 5. The bottom 7 includes an opening 8 to permit light transmission therethrough. In addition, sidewalls 9 connect the top rim 6 to the bottom 7 of the bowl shaped member 3.

In an embodiment of the invention, the top rim 6 has a relatively wide annular radius, as compared to a typical true-life soup bowl, thus enabling placement of apparatuses below the top rim 6 which, as will be described hereinafter, render the soup bowl attraction curiously interesting to visitor or guest participants, especially children.

Beneath the top rim 6 is a system of fog generator units 11 which produce a fog layer within and/or at the top of the bowl shaped member 3. A number of fog generator units 11 are spaced around the interior of the bowl shaped member 3 beneath the wide top rim 6. Each fog generator unit 11 has a fog generator output nozzle 13. Referring to FIG. 1, a series of such fog generator outputs 13 are shown distributed around the interior of the bowl shaped member 3. A sufficient number of fog generator units 11 are utilized so as to generate a thick fog layer 15 which gives the appearance that the bowl shaped member 3 holds hot soup.

It will be understood that the present invention relates to an entertainment attraction in which a bowl shaped member appears to hold hot, perhaps boiling, liquid. However, other applications of the invention are possible after the unique and inventive concepts are disclosed and understood. For example, the present invention may be used to depict a cauldron of hot soup or boiling water as part of an outdoor camping theme or a boiling cauldron containing a witch's brew may also be depicted as part of a Halloween theme.

As will be described subsequently in this specification, the fog is generated from a water source, and FIG. 1 shows a water distribution pipeline 17 feeding each of the spaced fog generator units 11 around the inner periphery of the bowl shaped member 3. A water supply pipe or tube 19 is connected to a water source (not shown), such as a common building water source.

An important aspect of the invention involves the creation of an image within the bowl shaped member 3 beneath the fog layer 15. In an embodiment, an imaging device, such as a projector and screen arrangement, may be provided. In FIG. 1, a slide projector 21 is shown to be controlled by a control unit 23 for selectively, and controllably, projecting an image toward convex mirror 25. The light impinging on convex mirror 25 is then redistributed at a much wider angle, as is evident by reference to the schematically drawn light ray 27.

The position of the projector 21 and convex mirror 25 is such that an image is projected onto an imaging device screen 29, which may be a plastic sheet, constructed similar to that of a rear projection television system, located beneath the fog layer 15 and viewable from a position above the top 5 of the bowl shaped member 3.

To make the soup bowl attraction even more interesting, a light illuminator, for example a fiberoptic cable, 31 is arranged around the interior of the bowl shaped member 3 against interior frame structure 4 and just under the inner periphery of the top rim 6. A fiberoptic feed line 33, which may be a single optical fiber or a bundle of such optical fibers, brings light to the fiberoptic cable 31 from a high intensity light source 35 mounted below the bowl shaped member 3 and out of sight of any visitor or guest participant. Preferably, a color wheel 37 slowly rotates by means of a low RPM motor and gearing reduction arrangement 39, thereby producing continuously changing colored light being transmitted over the fiberoptic cable network 33, 31 and illuminating the fog layer 15 in a mysterious and mystical way.

Any of the various described apparatuses which are required to project an image on screen 29, to provide a water source to the fog generator units 11, and to provide color lighting effects to the thick fog layer 15 may conveniently be placed under a platform 41 provided around the bottom 7 of the bowl shaped member 3. Platform 41 serves the additional purpose of providing a raised flooring for a visitor or guest participant, especially suitable for young children, so that the fog creation and lighting effects previously described can be readily and comfortably seen and appreciated by a visitor or guest participant 43 standing on the platform 41.

In order to provide an interactive aspect to the present invention, means may be provided to enable a visitor or guest participant 43 to cause the image projected on screen 29 to change. Toward that end, an object sensor apparatus 45, which may be implemented by a video camera, is positioned over the top of the bowl shaped member 3 and has an angle of view to cover the entire top 5 of the bowl shaped member 3. Known discrete electronic devices, or a microprocessor can be used to compare time-space images collected by the video camera 45 and output an object presence signal 63 (FIG. 3) when an image change is detected due to an object being placed over the top 5 of the bowl shaped member 3.

For example, if a visitor or guest participant 43 holds his or her hand over the top of the rim or the bowl shaped member 3, this would be detected by camera 45, and the aforementioned object presence signal 63 will be generated. The object presence signal 63 will then be routed to the image control unit 23 which will cause the slide projector 21 to change slides and, consequently, change the image projected onto image device screen 29.

Figure 2:
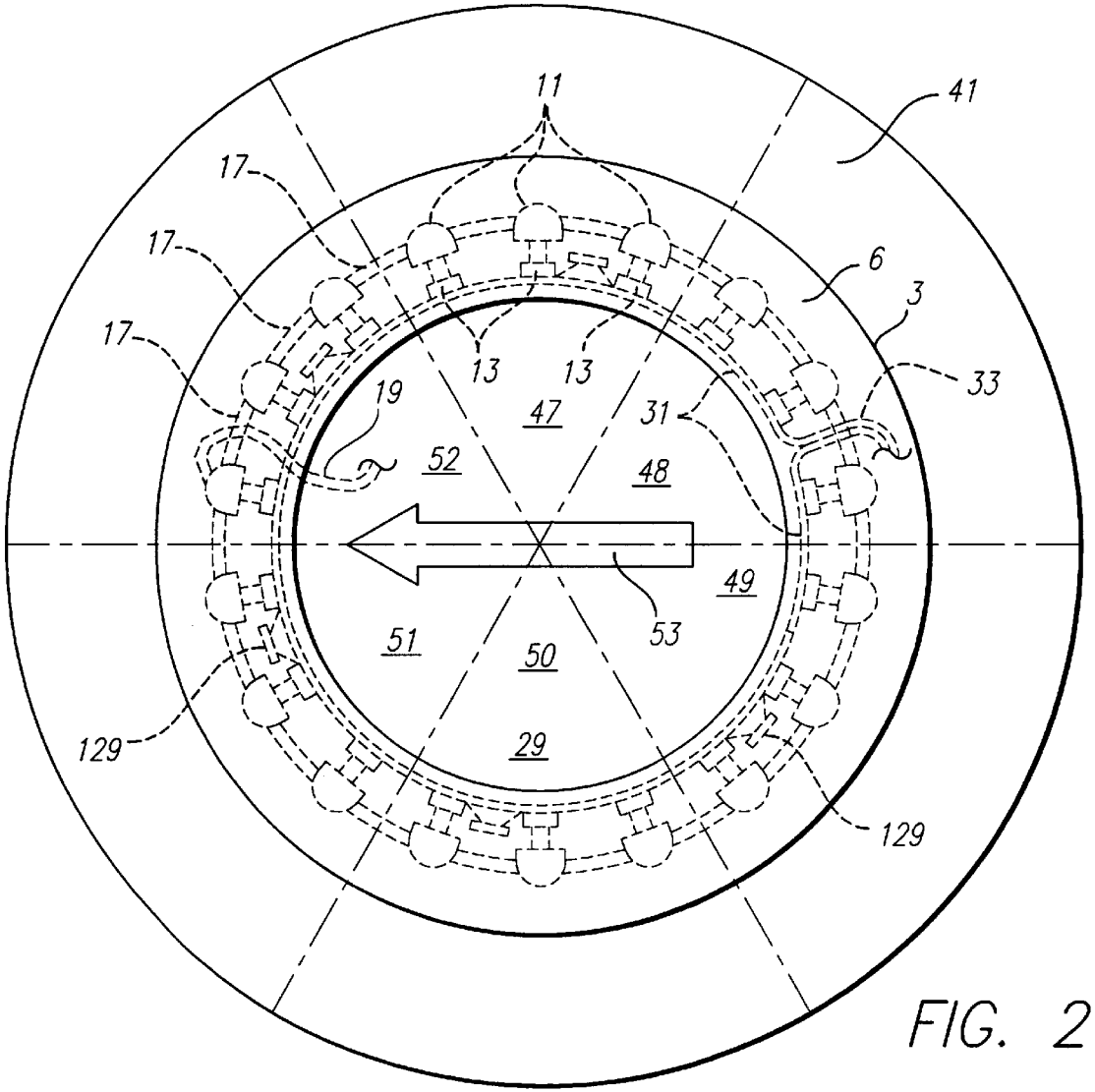
FIG. 2 is a top view of the soup bowl entertainment attraction shown in FIG. 1.

Going beyond simply sensing when a person's hand is held over the top 5 of the bowl shaped member 3, the bowl shaped member 3 may be divided into segments. Referring to FIG. 2, the bowl shaped member 3 is shown divided into six equal pie-shaped segments 47–52. As will be described hereinafter, an object being placed over any one of the segments 47–52 will cause a particular change in the image seen on the imaging device screen 29. In FIG. 2, a large arrow 53 is shown to be the image being projected on screen 29.

Figure 3:
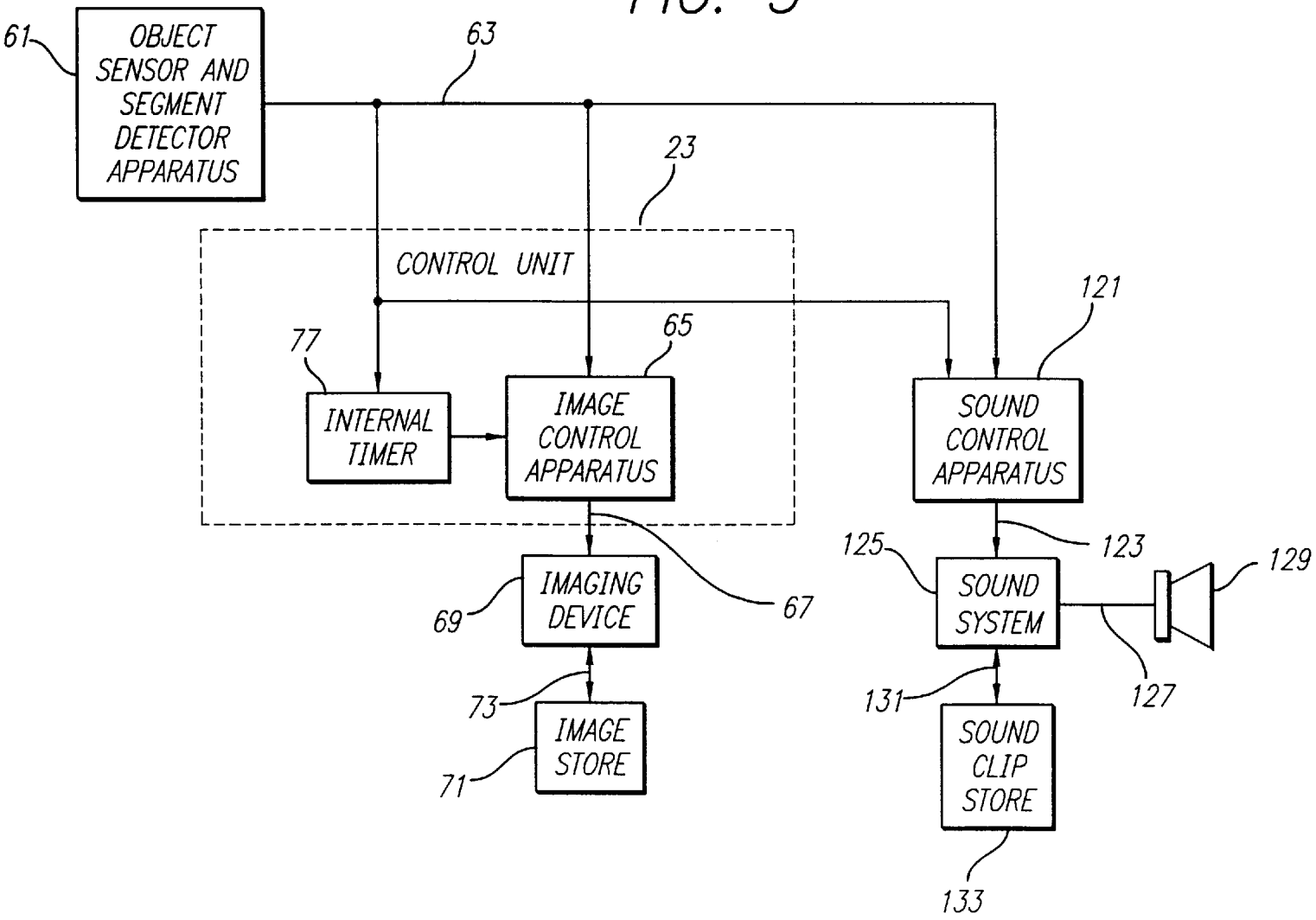
FIG. 3 is a block diagram of the functional operation of the soup bowl entertainment attraction.

Turning now to FIG. 3, a general block diagram of the various apparatuses and devices making up the operational units of the invention are shown. The video camera 45 and associated processing electronics (not shown) in FIG. 1 are represented in FIG. 3 by the function block 61 shown as an object sensor and segment detector apparatus. When a visitor or guest participant 43 holds his or her arm over any one of segments 47–52 of the bowl shaped member 3, an object presence signal 63 is generated, the signal 63 also including information as to which segment 47–52 over which an object has been detected. The object presence signal 63 is then routed to control unit 23 which includes an internal timer 77 and an image control apparatus 65. Image control apparatus 65 has an output 67 which controls the imaging device 69 so as to cause imaging device 69 to display a certain image or sequence of images on screen 29. For example, image control apparatus 65 may simply select a prescribed slide in the slide projector 21 (imaging device) corresponding to a respective object presence signal 63.

An image store 71 may be in the form of a carousel of different slides to be projected on screen 29, or it may be an electronic image storage device, outputting digitally stored information representing different selectable images on line 73. In this connection, it should be understood that imaging device 69 may be in the form of a video projector, an active matrix screen such as that used in the computer field, or any other known imaging device which is capable of displaying a large image on screen 29.

If it is assumed that the visitor or guest participant 43 holds his or her hand over segment 47 in FIG. 2, object sensor and segment detector apparatus 61 instructs image control apparatus 65 that a particular segment, in this instance segment 47, has been "activated". Image control apparatus 65 then signals imaging device 69 to select a different image from image store 71 and project that newly selected image onto the screen 29. When an object is placed over another segment 47–52, a different, and unique, object presence signal 63 is created, and imaging device 69, under control of the image control apparatus 65 selects a different image to be projected on screen 29, such image having a direct relationship to the specific object presence signal on line 63, i.e., to the new "active" segment. Accordingly, each time an object is placed over a segment 47–52 different from the previous active segment, a new predetermined image is substituted for the old one.

An internal timer 77 also controls image control apparatus 65 to cause images to be changed by the imaging device 69. However, internal timer 77 operates only under certain specific conditions. One condition is that the object sensor and segment detector apparatus 61 fails to detect any objects being held over the top 5 of the bowl shaped member 3 for a prescribed period of time. When internal timer 77 detects that there has been no object presence signal generated on line 63 for a prescribed period of time, this would indicate that there is no active visitor or guest participation happening. However, there still may be observers watching the screen 29 and yet not actively participating in the interactive game. In any event, the internal timer 77 will automatically instruct the image control apparatus to change the image being displayed on screen 29, and imaging device 69 is responsive to such instruction to carry out that function. If then an object is detected over any of segments 47–52, an object presence signal 63 is again generated which has precedence over control by internal timer 77.

Internal timer 77 has an additional function of encouraging visitor or guest participants to not linger too long at this entertainment attraction so as to permit other visitors and guests to take part in the interactive game. In this regard, after a prescribed period of time without changing images as a result of detecting objects over the top of the bowl shaped member 3 or as a result of automatic image changes under control of internal timer 77, internal timer 77 instructs image control apparatus 65 to cause imaging device 69 to display a default image, that being the arrow 53 shown in FIG. 2. This image may also include text which instructs the participants to move on to the next attraction at the facility by exiting in the direction of the arrow.

As indicated supra, there is optionally a sound system associated with the imaging system described above. When a visitor or guest participant 43 holds his or her arm over any one of segments 47–52 of the bowl shaped member 3, the object presence signal 63 generated, including information as to which segment 47–52 over which an object has been detected, is also routed to sound control apparatus 121. Sound control apparatus 121 has an output 123 which controls the sound system 125 so as to cause a certain sound clip or sequence of sound clips to be heard from speaker 129. For example, sound control apparatus 121 may simply select a prescribed sound track of a CD corresponding to a respective object presence signal 63.

A sound clip store 133 may, alternatively, be in the form of an integrated circuit, e.g., a ROM, containing selectable unique digitally stored sound clips outputted over line 131 and heard from speaker 129.

If it is assumed that the visitor or guest participant 43 holds his or her hand over segment 47 in FIG. 2, object sensor and segment detector apparatus 61 instructs sound control apparatus 121 that a particular segment, in this instance segment 47, has been "activated". Sound control apparatus 121 then signals sound system 125 to select a different sound clip from store 133 and reproduce that newly selected sound clip through speaker 129. When an object is placed over another segment 47–52, a different, and unique, object presence signal 63 is created, and sound system 125, under control of the sound control apparatus 121 selects a different sound clip to be played, such sound clip having a direct relationship to the specific object presence signal on line 63, i.e., to the new "active" segment.

Accordingly, each time an object is placed over a segment 47–52 different from the previous active segment, a new predetermined sound clip is substituted for the old one.

It will be understood that each sound clip stored in store 133 has a direct correspondence to a stored image in image store 71. Thus, when an image is selected for display, the corresponding sound clip is audibly presented.

Internal timer 77 also controls sound control apparatus 121 to cause sound clips to be changed by the sound system 125. Internal timer 77 operates only under certain specific conditions, as has already been described above. Thus, when internal timer 77 detects that there has been no object presence signal generated on line 63 for a prescribed period of time, this would indicate that there is no active visitor or guest participation happening. Since there still may be observers watching the screen 29 and yet not actively participating in the interactive game, the internal timer 77 will automatically instruct the sound control apparatus to change the sound clip being reproduced, and sound system 125 is responsive to such instruction to carry out that function. If then an object is detected over any of segments 47–52, an object presence signal 63 is again generated which has precedence over control by internal timer 77.

As also indicated above, internal timer 77 has the additional function of encouraging visitor or guest participants to not linger too long at this entertainment attraction so as to permit other visitors and guests to take part in the interactive game. In this regard, after a prescribed period of time without changing sound clips as a result of detecting objects over the top of the bowl shaped member 3 or as a result of automatic sound clip changes under control of internal timer 77, internal timer 77 instructs sound control apparatus 121 to cause sound system 125 to display a default sound clip, that being audible instructions verbally advising the participants to move on to the next attraction at the facility by exiting in the direction of the arrow imaged on the screen 29.

Figure 4:
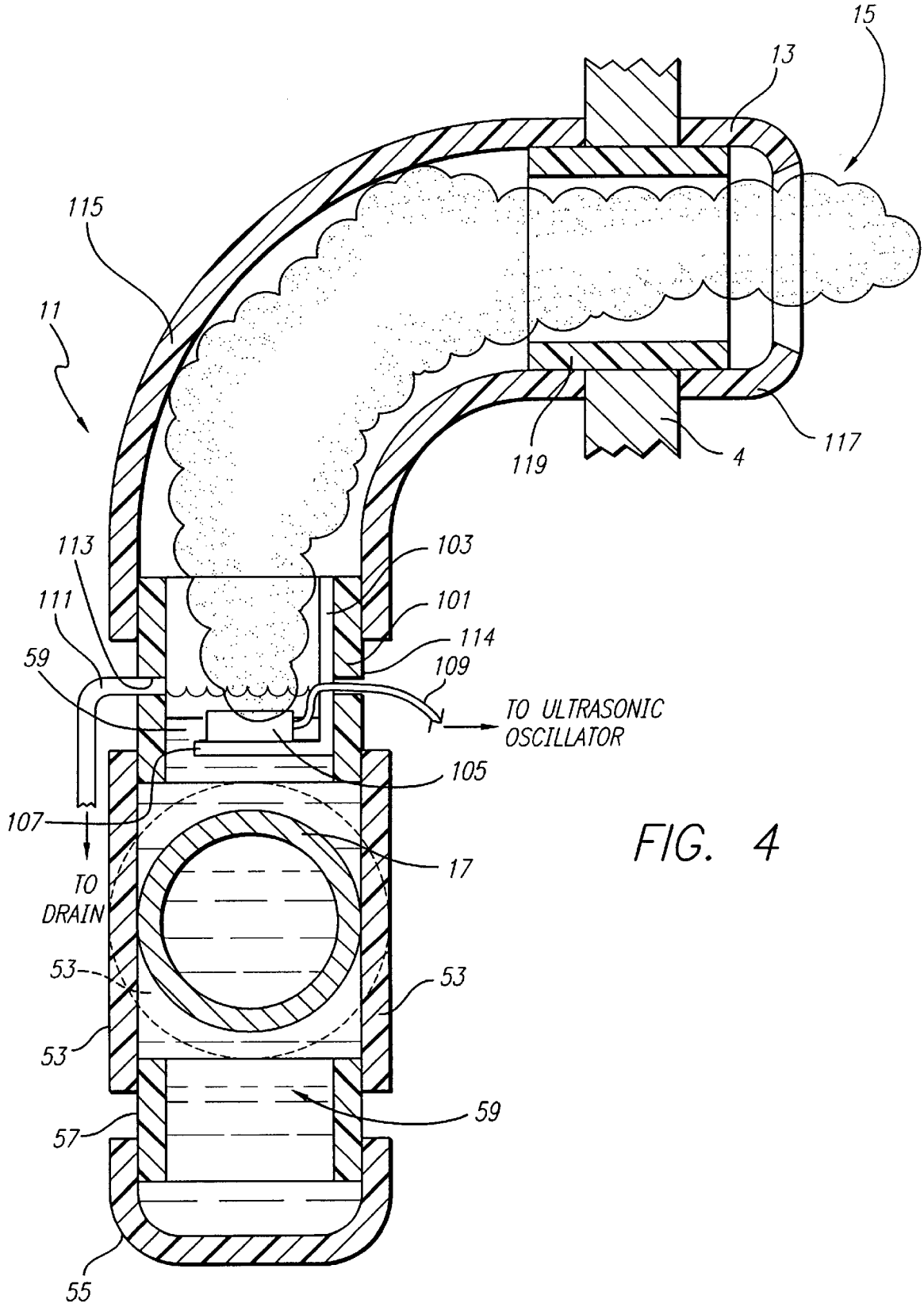
FIG. 4 is a side cross sectional view of a typical fog generator unit for creating a fog layer.

FIG. 4 is a side cross sectional view of a typical fog generator unit 11 for creating a fog layer 15. In an embodiment shown in FIG. 4, a number of segments of PVC water pipe is used. The basic structure of the fog generator unit 11 includes a 4-way coupler 53 (as best seen in FIG. 5) sealed by a bottom cap 55 coupled to the 4-way coupler 53 by a short bottom nipple 57.

The left and right arms of the 4-way coupler 53 are coupled to water distribution pipeline 17 leading to adjacent fog generator units 11. At the top arm of coupler 53, an upper nipple 101 is fixed in place, and the top of upper nipple 101 coupled to an elbow 115 the free end of which butts against the outer wall of interior frame structure 4. A wall coupler nipple 119 permits a tight fit of elbow 115 against interior frame structure 4 by the provision of an end cap 117 having an opening at its distal end and defining the fog generator output 13.

Within the upper nipple 101, a bracket 103 is fixed to the inside wall of nipple 101, bracket 103 having a platform portion 107 extending into the center of the nipple 101 for supporting a piezoelectric element 105 just below the surface of a level of water 59 contained within the fog generator unit 11.

In the event of excessive water 59 being provided into the fog generator system, an overflow drainpipe 111 will syphon off the excess water to a drain (not shown). Overflow drainpipe 111 passes through an opening 113 in upper nipple 101 and is sealed securely to it.

Another opening 114 is also provided in nipple 101 to permit the electrical connection to piezoelectric element 105 to pass therethrough and electrically connect to the output of an ultrasonic oscillator (not shown). The piezoelectric element 105 and ultrasonic oscillator (not shown) function similar to those commonly found in cold-steam vaporizers, and thus need not be described in detail herein. The high frequency signal from the ultrasonic oscillator (not shown) causes the piezoelectric element 105 to vibrate at a high frequency and at a large energy level so as to vibrate the water above the piezoelectric element 105 vigorously and breaking it down into small water droplets, thereby generating the simulated hot steam at the top of the bowl shaped member 3.

In one embodiment of the invention, a water source (not shown) fills the water distribution pipeline 17 and fog generator units 11 to an appropriate level, and a continuous fresh water supply is provided at a rate sufficient to replace whatever water is evaporated into the atmosphere from the generated fog layer. As indicated, any excess water that accumulates in the system will drain off through overflow drainpipe 111, and if the system is adjusted properly, very little water waste, if any, will be realized.

To improve upon the water source/level arrangement previously described, an arrangement as shown in FIG. 6 may be employed. In FIG. 6, within the same upper nipple 101, but spaced from the piezoelectric element 105, there may be provided a water inlet 79 connected to a water source and routed to a controllable water valve 81. A water nozzle 83 is connected to the output side of the controllable water valve 81 and passes through the upper nipple 101 so as to deposit the water passing through valve 81 into the water distribution pipeline 17 for distribution to fog generator units 11.

The level of the water 59 within the system is regulated by the opening and closing of valve 81. Control of valve 81 will now be described.

Withing the interior of upper nipple 101, there is fixed in place a bracket 84 which supports a water level sensing arrangement to be described. A float 85 has a central opening at its bottom loosely fitting over an upwardly directed vertical float support 87. Float support 87 will keep float 85 in a fixed position laterally of the axis of the upper nipple 101 but permit movement of the float 85 along a line parallel to the axis of upper nipple 101.

Attached to the top of float 85 is a vertically extending vane projecting through an opening 90 in the upper portion of bracket 84 defining a platform 91 for a water level sensor arrangement. The water level sensor arrangement is comprised of a light transmitter 93 and light receiver 95. Such transmit/receive devices are commonly used in all kinds of apparatuses and thus need not be explained in operation in this specification.

An electrical cabling 97 provides power to the light transmitter 93 and provides a signal transmission line from the receiver 95, cable 97 being coupled to a water level detector 99 which responds to the reception by receiver 95 of light emanating from light transmitter 93, and in turn develops a control voltage applied to controllable water valve 81 to open it and allow water from the water source to enter the water distribution pipeline 17 and fog generator units 11. This opening of valve 81 occurs only when float 85 drops to such a level that light from transmitter 93 is received by receiver 95 and causes water level detector 99 to energize valve 81. As the water level within nipple 101 then rises, float 85 rises higher until vane 89 blocks the light path between the light transmitter 93 and light receiver 95. In this condition, water level detector 99 responds by removing power to the controllable water valve 81, thereby shutting it off, thereby keeping the water level relatively constant within the system.

While only certain embodiments have been set forth, alternative embodiments and various modifications will be apparent from the above description to those skilled in the art. These and other alternatives are considered equivalents and within the spirit and scope of the present invention.

What is claimed is:

1. A simulated soup bowl entertainment attraction, comprising:

a bowl shaped member having a top bounded by a top rim, a bottom permitting light transmission therethrough, and sidewalls connecting said top rim with said bottom;

a fog generator producing a fog layer at said top of said bowl shaped member; and an imaging device producing an image within said bowl shaped member, the image viewable from a viewing position looking down into said top of said bowl shaped member.

2. The simulated soup bowl attraction as claimed in claim 1, comprising:

an image controlling apparatus coupled to said imaging device, said image controlling apparatus adapted to change the image viewable from said viewing position.

3. The simulated soup bowl attraction as claimed in claim 2, wherein said imaging device comprises:

a projector projecting said image; and a screen displaying said projected image, said screen disposed within said bowl shaped member beneath said fog layer.

4. The simulated soup bowl attraction as claimed in claim 2, comprising:

object sensor apparatus sensing the presence of an object positioned over said top of said bowl shaped member and generating an object presence signal routed to said image controlling apparatus; and wherein said image controlling apparatus is operative to change said image presented to said imaging device responsive to receiving said object presence signal.

5. The simulated soup bowl attraction as claimed in claim 4, wherein:

upon receiving said object presence signal, said image controlling apparatus exchanges a current image with a replacement image.

6. The bowl shaped entertainment attraction as claimed in claim 4, comprising an image store, and wherein:

said bowl shaped member top is divided into a plurality of bowl segments;

said image store comprises a plurality of different stored images, each said stored image being associated with one of said bowl segments;

said object sensor apparatus comprises a bowl segment detector operative to identify the bowl segment over which an object is present, thereby defining an active bowl segment;

said object presence signal includes identification information representing an active bowl segment; and said image controlling apparatus, responsive to said presence signal, is operative to instruct said imaging device to select from said image store a stored image associated with the segment represented in said object presence signal.

7. The simulated soup bowl attraction as claimed in claim 6, comprising:

a timer connected to said object sensor apparatus and to said image controlling apparatus for measuring the time interval between the detection of the presence of objects positioned over said bowl shaped member top, said timer generating a default object presence signal routed to said image controlling apparatus for effecting periodic image changes in the absence of object presence signals generated by actual objects being present over said bowl shaped member top.

8. The simulated soup bowl attraction as claimed in claim 4, wherein:

said sensor apparatus comprises a camera disposed above said bowl shaped member, said camera outputting object presence information and active bowl segment information to said image controlling apparatus.

9. The simulated soup bowl attraction as claimed in claim 1, wherein said fog generator comprises:

a fog source; and a fog distribution system for distributing fog uniformly over said bowl shaped member top.

10. The simulated soup bowl attraction as claimed in claim 9, wherein:

said fog source comprises an ultrasonic unit having a vibrating surface in contact with a water supply; and said fog distributing system comprises a multi-outlet pipeline within said bowl shaped member and extending along and under said top rim, said pipeline having a fog inlet coupled to said fog source to collect fog generated by said ultrasonic unit, and having multiple outlets distributed around said bowl shaped member top rim.

11. The simulated soup bowl attraction as claimed in claim 10, wherein:

said fog source comprises a plurality of said fog sources; and said pipeline comprises a like plurality of fog inlets coupled to respective ones of said fog sources.

12. The simulated soup bowl attraction as claimed in claim 1, comprising:

a light source within said bowl shaped member producing light that is distributed around said top rim to illuminate said fog layer.

13. The simulated soup bowl attraction as claimed in claim 12, wherein:

said light source produces light of different colors.

14. The simulated soup bowl attraction as claimed in claim 12, wherein:

said light source comprises a lighting effects generator for altering the visual characteristics of said distributed light.

15. A bowl shaped entertainment attraction, comprising:

a bowl shaped member having a top, a bottom, and an interior;

a fog generator producing a fog layer within said bowl shaped member interior; and an imaging device producing an image within said bowl shaped member.

16. The bowl shaped entertainment attraction as claimed in claim 15, comprising:

an image controlling apparatus coupled to said imaging device, said image controlling apparatus adapted to change the image within said bowl shaped member.

17. The bowl shaped entertainment attraction as claimed in claim 16, wherein said imaging device comprises:

a projector projecting said image; and a screen displaying said projected image, said screen disposed within said bowl shaped member beneath said fog layer.

18. The bowl shaped entertainment attraction as claimed in claim 16, comprising:

object sensor apparatus sensing the presence of an object positioned over said top of said bowl shaped member and generating an object presence signal routed to said image controlling apparatus; and wherein said image controlling apparatus is operative to change said image presented to said imaging device responsive to receiving said object presence signal.

19. The bowl shaped entertainment attraction as claimed in claim 18, wherein:

upon receiving said object presence signal, said image controlling apparatus exchanges a current image with a replacement image.

20. The bowl shaped entertainment attraction as claimed in claim 18, comprising an image store, and wherein:

said bowl shaped member top is divided into a plurality of bowl segments;

said image store comprises a plurality of different stored images, each said stored image being associated with one of said bowl segments;

said object sensor apparatus comprises a bowl segment detector operative to identify the bowl segment over which an object is present, thereby defining an active bowl segment;

said object presence signal includes identification information representing an active bowl segment; and said image controlling apparatus, responsive to said presence signal, is operative to instruct said imaging device to select from said image store a stored image associated with the segment represented in said object presence signal.

21. The bowl shaped entertainment attraction as claimed in claim 20, comprising:

a timer connected to said object sensor apparatus and to said image controlling apparatus for measuring the time interval between the detection of the presence of objects positioned over said bowl shaped member top, said timer generating a default object presence signal routed to said image controlling apparatus for effecting periodic image changes in the absence of object presence signals generated by actual objects being present over said bowl shaped member top.

22. The bowl shaped entertainment attraction as claimed in claim 18, wherein:

said sensor apparatus comprises a camera disposed above said bowl shaped member, said camera outputting object presence information and active bowl segment information to said image controlling apparatus.

23. The bowl shaped entertainment attraction as claimed in claim 15, wherein said fog generator comprises:

a fog source; and a fog distribution system for distributing fog uniformly over said bowl shaped member top.

24. The bowl shaped entertainment attraction as claimed in claim 23, wherein:

said bowl shaped member top comprises a peripheral top rim;

said fog source comprises an ultrasonic unit having a vibrating surface in contact with a water supply; and said fog distributing system comprises a multi-outlet pipeline within said bowl shaped member and extending along and under said top rim, said pipeline having a fog inlet coupled to said fog source to collect fog generated by said ultrasonic unit, and having multiple outlets distributed around said bowl shaped member top rim.

25. The bowl shaped entertainment attraction as claimed in claim 24, wherein:

said fog source comprises a plurality of said fog sources; and said pipeline comprises a like plurality of fog inlets coupled to respective ones of said fog sources.

26. The bowl shaped entertainment attraction as claimed in claim 15, comprising:

a peripheral rim surrounding said bowl shaped member top; and a light source within said bowl shaped member producing light that is distributed around said top rim to illuminate said fog layer.

27. The bowl shaped entertainment attraction as claimed in claim 26, wherein:

said light source produces light of different colors.

28. The bowl shaped entertainment attraction as claimed in claim 26, wherein:

said light source comprises a lighting effects generator for altering the visual characteristics of said distributed light.

29. A bowl shaped entertainment attraction, comprising:

a bowl shaped member having a top and a bottom;

fog producing means for producing a fog layer in said bowl shaped member; and image producing means for producing an image within said bowl shaped member viewable through said fog layer.

30. The bowl shaped entertainment attraction as claimed in claim 29, comprising:

a control means coupled to said image producing means, said control means adapted to change the image produced by said image producing means and viewable in said bowl shaped member.

31. The bowl shaped entertainment attraction as claimed in claim 30, wherein said image producing means comprises:

a projector projecting said image; and a screen displaying said projected image, said screen disposed within said bowl shaped member beneath said fog layer.

32. The bowl shaped entertainment attraction as claimed in claim 30, comprising:

sensing means for sensing the presence of an object positioned over said top of said bowl shaped member, and generating an object presence signal routed to said control means; and wherein said control means is operative to cause said image producing means to change said image within said bowl shaped member responsive to receiving said object presence signal.

33. The bowl shaped entertainment attraction as claimed in claim 32, wherein:

upon receiving said object presence signal, said control means exchanges a current image with a replacement image.

34. The bowl shaped entertainment attraction as claimed in claim 32, comprising an image store, and wherein:

said bowl shaped member top is divided into a plurality of bowl segments;

said image store comprises a plurality of different stored images, each said stored image being associated with one of said bowl segments;

said sensing means comprises a bowl segment detector operative to identify the bowl segment over which an object is present, thereby defining an active bowl segment;

said object presence signal includes identification information representing an active bowl segment; and said control means, responsive to said presence signal, is operative to instruct said image producing means to select from said image store a stored image associated with the segment represented in said object presence signal.

35. The bowl shaped entertainment attraction as claimed in claim 34, comprising:

a timer connected to said object sensor apparatus and to said control means for measuring the time interval between the detection of the presence of objects positioned over said bowl shaped member top, said timer generating a default object presence signal routed to said control means for effecting periodic image changes in the absence of object presence signals generated by actual objects being present over said bowl shaped member top.

36. The bowl shaped entertainment attraction as claimed in claim 32, wherein:

said sensor apparatus comprises a camera disposed above said bowl shaped member, said camera outputting object presence information and active bowl segment information to said control means.

37. The bowl shaped entertainment attraction as claimed in claim 29, wherein said fog producing means comprises:

a fog source; and a fog distribution system for distributing fog uniformly over said bowl shaped member top.

38. The bowl shaped entertainment attraction as claimed in claim 37, wherein:

said bowl shaped member top comprises a peripheral top rim;

said fog source comprises an ultrasonic unit having a vibrating surface in contact with a water supply; and said fog distributing system comprises a multi-outlet pipeline within said bowl shaped member and extending along and under said top rim, said pipeline having a fog inlet coupled to said fog source to collect fog generated by said ultrasonic unit, and having multiple outlets distributed around said bowl shaped member top rim.

39. The bowl shaped entertainment attraction as claimed in claim 38, wherein:

said fog source comprises a plurality of said fog sources; and said pipeline comprises a like plurality of fog inlets coupled to respective ones of said fog sources.

40. The bowl shaped entertainment attraction as claimed in claim 29, comprising:

a light source within said bowl shaped member producing light that is distributed around and adjacent said top to illuminate said fog layer.

41. The bowl shaped entertainment attraction as claimed in claim 40, wherein:

said light source produces light of different colors.

42. The bowl shaped entertainment attraction as claimed in claim 40, wherein:

said light source comprises a lighting effects generator for altering the visual characteristics of said distributed light.

43. The bowl shaped entertainment attraction as claimed in claim 29, comprising:

sound producing means for producing sound within said bowl shaped member.

44. The bowl shaped entertainment attraction as claimed in claim 43, comprising:

a control means coupled to said sound producing means, said control means adapted to change the sound produced by said sound producing means.

45. The bowl shaped entertainment attraction as claimed in claim 44, comprising:

sensing means for sensing the presence of an object positioned over said top of said bowl shaped member, and generating an object presence signal routed to said control means; and wherein said control means is operative to cause said sound producing means to change said sound within said bowl shaped member responsive to receiving said object presence signal.

46. The bowl shaped entertainment attraction as claimed in claim 45, wherein:

upon receiving said object presence signal, said control means exchanges a current sound with a replacement sound.

47. The bowl shaped entertainment attraction as claimed in claim 45, comprising a sound clip store, and wherein:

said bowl shaped member top is divided into a plurality of bowl segments;

said sound clip store comprises a plurality of different stored sound clips, each said stored sound clip being associated with one of said bowl segments;

said sensing means comprises a bowl segment detector operative to identify the bowl segment over which an object is present, thereby defining an active bowl segment;

said object presence signal includes identification information representing an active bowl segment; and said control means, responsive to said presence signal, is operative to instruct said sound producing means to select from said sound clip store a stored sound clip associated with the segment represented in said object presence signal.

48. The bowl shaped entertainment attraction as claimed in claim 47, comprising:

a timer connected to said object sensor apparatus and to said control means for measuring the time interval between the detection of the presence of objects positioned over said bowl shaped member top, said timer generating a default object presence signal routed to said control means for effecting periodic sound clip changes in the absence of object presence signals generated by actual objects being present over said bowl shaped member top.

49. The bowl shaped entertainment attraction as claimed in claim 43, wherein said sound producing means comprises:

a sound system amplifier; and a speaker arrangement projecting sound within said bowl shaped member beneath said fog layer.

50. An entertainment attraction, comprising:

a housing having a top portion and a bottom portion which include top and bottom openings, respectively, wherein said bottom portion is smaller in size than said top portion;

sidewalls extending downward from said top portion and inwardly toward said bottom portion to form a substantially bowl shaped configuration;

a fog generator producing a fog layer near said top portion;

an object sensor positioned near said top portion, wherein when an object is detected an object presence signal is generated;

an imaging device which generates an image within said housing responsive to said object presence signal; and a platform positioned around said bottom portion for supporting viewers of said image.

* * * * *